US007478818B1

(12) United States Patent
Whiteside et al.

(10) Patent No.: US 7,478,818 B1
(45) Date of Patent: Jan. 20, 2009

(54) CREEPER WITHOUT SIDE RAILS

(75) Inventors: Kirt E. Whiteside, Marion, OH (US); Shane Obitts, Elyria, OH (US)

(73) Assignee: Whiteside Mfg. Co., Delaware, OH (US)

( * ) Notice: Subject to any disclaimer, the term of this patent is extended or adjusted under 35 U.S.C. 154(b) by 62 days.

(21) Appl. No.: 11/339,277

(22) Filed: Jan. 26, 2006

Related U.S. Application Data

(60) Provisional application No. 60/649,161, filed on Feb. 3, 2005.

(51) Int. Cl.
*B25H 5/00* (2006.01)

(52) U.S. Cl. ..... 280/32.6; 280/32.5; 280/639; 280/79.11; 280/641; 280/43.24

(58) Field of Classification Search ..... 280/32.6, 280/32.5, 5, 254, 636, 639, 79.11, 641, 43.24, 280/43.25
See application file for complete search history.

(56) References Cited

U.S. PATENT DOCUMENTS

| | | | | | |
|---|---|---|---|---|---|
| 4,369,987 | A | * | 1/1983 | Witherell | 280/644 |
| 5,174,592 | A | | 12/1992 | Pool | 280/32.6 |
| 5,251,359 | A | * | 10/1993 | Finkl | 16/349 |
| D351,707 | S | | 10/1994 | Pill | D34/23 |
| 5,364,201 | A | * | 11/1994 | LaBarre | 403/322.1 |
| 5,494,305 | A | * | 2/1996 | Chen | 280/32.6 |
| 5,611,552 | A | * | 3/1997 | Miles et al. | 280/32.6 |
| 5,730,449 | A | * | 3/1998 | Miles | 280/32.6 |
| D396,920 | S | | 8/1998 | Whiteside et al. | D34/23 |
| D398,433 | S | | 9/1998 | Whiteside et al. | D34/23 |
| D401,714 | S | | 11/1998 | Whiteside et al. | D34/23 |
| D403,822 | S | | 1/1999 | Whiteside et al. | D34/23 |
| D409,344 | S | | 5/1999 | Whiteside et al. | D34/23 |
| 6,076,838 | A | * | 6/2000 | Peterson et al. | 280/32.6 |
| D436,708 | S | | 1/2001 | Whiteside | D34/27 |
| D444,282 | S | * | 6/2001 | Lensing et al. | D34/23 |
| D458,432 | S | | 6/2002 | Whiteside et al. | D34/23 |
| 6,705,622 | B2 | * | 3/2004 | Whiteside | 280/32.6 |
| 6,871,861 | B2 | * | 3/2005 | Hernandez, Jr. | 280/32.6 |
| 7,032,909 | B2 | * | 4/2006 | Lensing | 280/32.6 |
| D521,708 | S | * | 5/2006 | Obbitts et al. | D34/23 |
| D522,707 | S | * | 6/2006 | Obbitts et al. | D34/23 |
| D530,877 | S | * | 10/2006 | Staples | D34/23 |

OTHER PUBLICATIONS

Publication of Lisle Corp., Clarinda, Iowa, pp. 44 and 45, undated.
Cover page of 1993 Catalog of Whiteside Mfg. Co., Delaware, Ohio.

* cited by examiner

*Primary Examiner*—Christopher P Ellis
*Assistant Examiner*—Cynthia F Collado
(74) *Attorney, Agent, or Firm*—Renner, Kenner, Greive, Bobak, Taylor & Weber

(57) ABSTRACT

A creeper (10) includes a first frame portion (11) and a second frame portion (12). The frame portions (11, 12) are connected to each other only by longitudinally extending rails (13). Each frame portion (11, 12) is generally U-shaped having arms (16) which carry caster assemblies (18) and a base member (17) which interconnects the arms (16). The rails (13) extend between the base members (17) of the frames (11, 12).

15 Claims, 3 Drawing Sheets

CREEPER WITHOUT SIDE RAILS

CROSS-REFERENCE TO RELATED APPLICATION

This application claims the benefit of U.S. Provisional Application No. 60/649,161 filed Feb. 3, 2005.

TECHNICAL FIELD

This invention relates to a mechanic's creeper. More particularly, this invention relates to a creeper which can be economically manufactured without the side rails found in typical creepers.

BACKGROUND ART

Known mechanic's creepers include a frame having parallel, longitudinally extending side rails that carry casters, usually six in number, which render the creeper mobile. The side rails are interconnected at their ends and also by a plurality of laterally extending, longitudinally spaced crossmembers which hold a pad which supports the body of the user of the creeper.

A problem with creepers having these types of frames is that the weight of the frames and the number of casters contributes significantly to the cost thereof. Another drawback is that the crossmembers can interfere with the ability of the user to gain ready access to something under the creeper. That is, oftentimes a tool, fastener or the like, which is being employed by the user of the creeper, will find its way under the creeper, and if the user attempts to reach under the creeper to gain access to the item, the crossmembers will prohibit the user from doing so.

On the other hand, when designing the frame for a creeper, one must be careful not to greatly sacrifice stability and strength for the sake of cost and convenience. Thus, the need exists for a creeper which is provided with a frame of reduced structure such that it can be inexpensively produced without sacrificing strength and quality.

DISCLOSURE OF THE INVENTION

It is thus an object of the present invention to provide a creeper having a frame which does not include the typical side rails of the prior art.

It is another object of the present invention to provide a creeper, as above, which can be economically manufactured and yet be structurally sound.

These and other objects of the present invention, as well as the advantages thereof over existing prior art forms, which will become apparent from the description to follow, are accomplished by the improvements hereinafter described and claimed.

In general, a creeper made in accordance with the present invention includes a first frame and a second frame separate from said first frame. At least one rail connects the second frame to the first frame. A pad is carried by the frames and the rail.

A preferred exemplary creeper according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
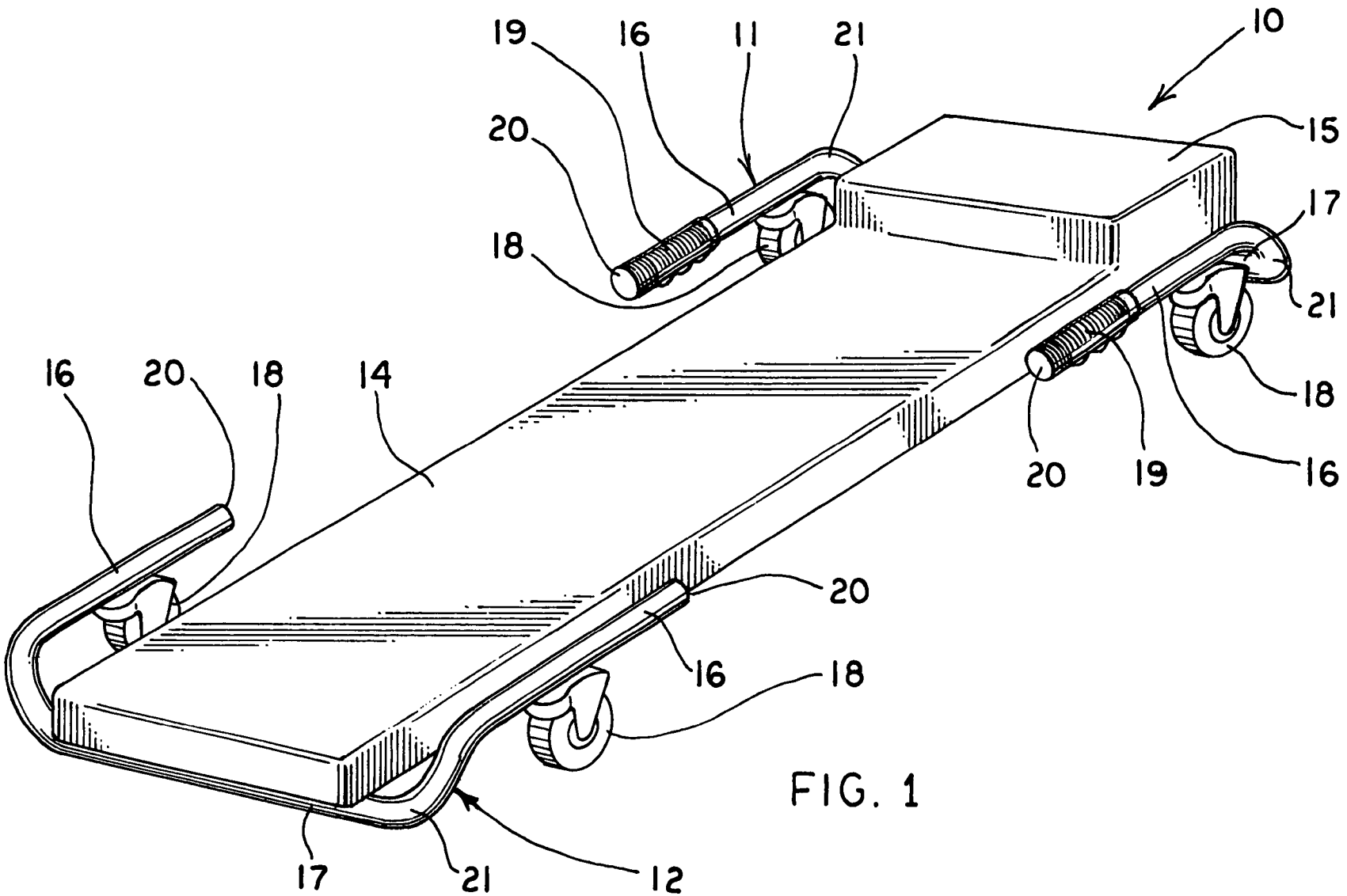
FIG. 1 is a perspective view showing a creeper made in accordance with the present invention.
Figure 2:
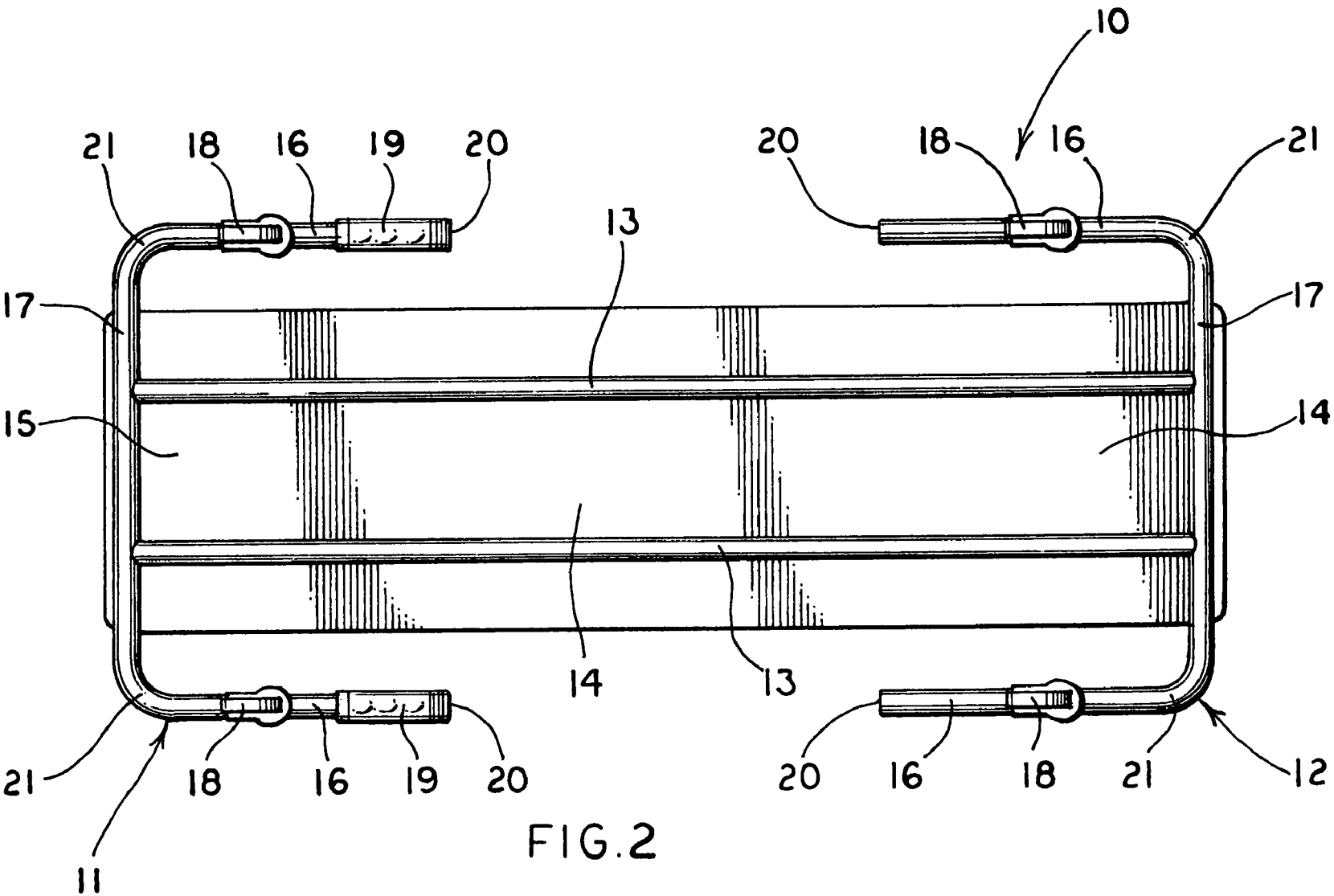
FIG. 2 is a bottom plan view of the creeper shown in FIG. 1.
Figure 3:
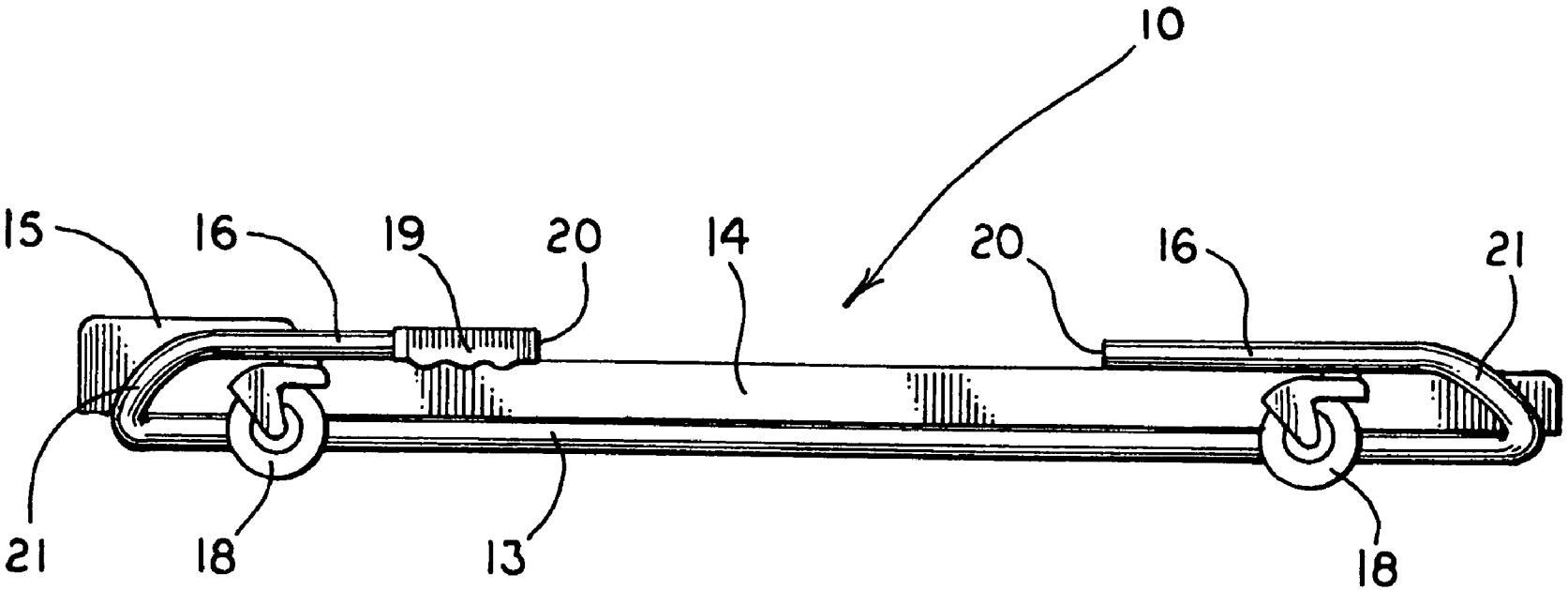
FIG. 3 is a side elevational view of the creeper shown in FIG. 1.

A mechanic's creeper made in accordance with the concepts of the present invention is indicated generally by the numeral 10. Creeper 10 includes a first frame portion, generally indicated by the numeral 11, and a second frame portion, generally indicated by the numeral 12. Frame portions 11 and 12 are spaced from each other and are interconnected by one or more longitudinally extending rails 13 (two shown). Rails 13 are uninterrupted by the lateral supports normally found in the prior art, and, together with frame portions 11 and 12, rails 13 carry a body pad 14 and a headrest 15 of creeper 10.

Frame portions 11 and 12 are, for the most part, identical, and are conveniently made out of round tubing, preferably aluminum. Frame portions 11 and 12 are bent into the configuration shown which is U-shaped in plan view having arms 16 extending longitudinally along pad 14. Arms 16 are spaced by, and connected to, a base member 17. Each arm 16 is thus spaced somewhat laterally, outwardly from pad 14, and arms 16 are positioned generally in the same plane as pad 14. Each arm 16 extends only a portion of the length of pad 14, preferably about twenty to thirty percent of the length of pad 14. Each arm 16 carries a caster assembly 18 positioned generally midway of its length. Thus, creeper 10 is rendered mobile by the four caster assemblies 18 shown. The end of arms 16 of frame portion 11 may be provided with conventional hand grips 19 to assist in maneuvering creeper 10.

In view of this configuration, the ends 20 of arms 16 opposite to base member 17 are spaced from, are aligned with, and face each other or otherwise point at each other. The opposite ends 21 of arms 16 curve downwardly and inwardly to meet base member 17. Thus, base member 17 of frame portion 11 is positioned under headrest 15, and the base member 17 of frame portion 12 is positioned under the end of pad 14 opposite to headrest 15. Rails 13 extend between, and otherwise connect, the base members 17 of frame portions 11 and 12.

In light of the foregoing, it should thus be evident that a creeper without side rails constructed as described herein substantially improves the art.

What is claimed is:

1. A creeper comprising a first frame, a second frame separate from said first frame, each said frame being generally U-shaped having opposed arms and a base member interconnecting said arms, at least one rail extending from said base member of said second frame to said base member of said first frame, and a pad carried by said frames and said rail, wherein said arms of each said frame have an arm length and said rail has a rail length, said rail length being greater than the sum of said first frame arm length and said second frame arm length, and wherein the ends of said arms of said first frame are spaced from and face the ends of said second frame.

2. The creeper of claim 1 further comprising hand grips positioned on the end of said arms of said first frame.

3. The creeper of claim 1 wherein said base members are positioned under said pad.

4. The creeper of claim 1 wherein said arms are generally in the same plane as said pad.

5. The creeper of claim 1 wherein the ends of said arms of said first frame are spaced from and face the end of said arms of said second frame.

6. The creeper of claim 1 wherein one end of said arms of said first frame curve downwardly to said base member of said first frame and one end of said arms of said second frame curve downwardly to said base member of said second frame.

7. The creeper of claim 1 further comprising a caster assembly carried by each said arm of said first frame and each said arm of said second frame.

8. The creeper of claim 1 wherein said pad includes a headrest at one end positioned above said first frame, the other end of said pad positioned above said second frame.

9. A creeper comprising a first frame having laterally spaced arms having an arm length, a second frame having laterally spaced arms having an arm length, at least one longitudinally extending rail laterally spaced from said arms of said first and said second frames and connecting said frames and having a rail length, and a longitudinally extending pad carried by said frames and said at least one longitudinally extending rail, wherein said rail length is greater than the sum of length, and wherein the ends of said arms of said first frame are spaced from and face the ends of said second frame.

10. The creeper of claim 9 wherein said arms of said first frame are longitudinally spaced from said arms of said second frame.

11. The creeper of claim 10 where said arms of said first frame and said arms said second frame each extend approximately twenty to thirty percent of the longitudinal extent of said pad.

12. The creeper of claim 9 wherein said rail is the only connection between said frames.

13. A creeper comprising a first frame having laterally spaced arms having an arm length, a second frame having laterally spaced arms having an arm length, said arms of said first frame not being connected to said arms of said second frame, at least one rail extending longitudinally between said frames and connecting said frames and having a rail length, and a pad carried by said frames and said at least one rail, wherein said rail length is greater than the sum of said first frame arm length and said second frame arm length, and wherein the ends of said arms of said first frame are spaced from and face the ends of said second frame.

14. The creeper of claim 13, each said frame having a base member extending laterally between said arms, said rail connecting said base members and being the only connection between said frames.

15. The creeper of claim 14 where said arms of said first frame and said arms said second frame each extend approximately twenty to thirty percent of the longitudinal extent of said pad.

* * * * *